United States Patent [19]

Phillips

[11] 4,155,180

[45] May 22, 1979

[54] FOOTWEAR FOR MORE EFFICIENT RUNNING

[75] Inventor: Edward H. Phillips, Mountain View, Calif.

[73] Assignee: American Fitness, Inc., Woodside, Calif.

[21] Appl. No.: 881,383

[22] Filed: Feb. 27, 1978

Related U.S. Application Data

[63] Continuation-in-part of Ser. No. 644,504, Dec. 29, 1975, abandoned.

[51] Int. Cl.[2] ..... A43B 5/00; A43B 13/38

[52] U.S. Cl. ..... 36/129; 36/43; 36/103

[58] Field of Search ..... 36/129, 43, 44, 32 R, 36/25 R, 83, 103, 7.5, 69

[56] References Cited

U.S. PATENT DOCUMENTS

| | | | |
|---|---|---|---|
| 1,564,232 | 12/1925 | Golden | 36/129 |
| 2,810,213 | 10/1957 | Jonas | 36/1 |
| 3,561,141 | 2/1971 | Brown | 36/44 |
| 3,584,402 | 6/1971 | Silverman | 36/7.5 |
| 3,918,181 | 11/1975 | Inohara | 36/129 |
| 3,968,577 | 7/1976 | Jackson | 36/43 |

*Primary Examiner*—Patrick D. Lawson
*Attorney, Agent, or Firm*—Flehr, Hohbach, Test, Albritton & Herbert

[57] ABSTRACT

A running shoe has an outer sole surface contoured uninterruptedly from a mid-sole landing zone to a relieved or negative heel at the rear and an upturned toe-off zone at the front to induce a rolling motion along the sole during the running stride. The shoe includes a shoe shell with a relatively incompressible outer sole structure and an internal suspension member compliant to the foot and formed of relatively compressible material formed to conform with the shoe shell.

The method of manufacturing the shoe includes the steps of making a positive casting reflecting the weight bearing condition of the runner's foot or feet, and conforming the suspension member to the casting. The method also includes forming the outer shoe shells with curved outer soles and inserting the suspension members to complete the shoes.

7 Claims, 14 Drawing Figures

FOOTWEAR FOR MORE EFFICIENT RUNNING

REFERENCE TO PRIOR APPLICATION

This application is a continuation in part of my earlier application, Ser. No. 644,504, which was filed Dec. 29, 1975, and now abandoned.

BACKGROUND OF THE INVENTION

This invention relates to footwear for running and specifically to improved footwear wherein the contour on the outer sole surface and associated structure produces a more efficient running action in that the runner is able to move the feet with a smoother, more efficient rolling motion along the running surface during the normal running stride.

There are many known running shoes and sole configurations which have evolved over the last 20–30 years. The object of these has been to improve the fit with the foot, reduce shoe weight and increased confort for the runner. In this prior art certain developments were intended to reduce heel shock upon landing in the foot stride and minimize the associated stress upon the various joints affected. These developments centered around improving the quality and quantity of flexible sponge material arranged between the runner's heel and the heel portion of the sole. That approach created two types of instability upon landing at the heel. The force couple to the shoe's reaction at the rear of the heel against the applied force directed through the runner's ankle was in a forward direction such as to propel the front of the shoe and the runner's foot downward causing the sole to slap the ground and send secondary shocks through the runner's lower extremities. Secondly, the thick mass of sponge material lacked lateral support and when arranged in a design with an exaggerated heel elevation made the runner prone to turning ankles when traversing uneven terrain. It is also believed that standing, walking or running with an elevated heel shoe structure is undesirable from a posture standpoint and may induce back problems with the runner. The present invention is concerned with providing a sole contour specifically adapted to efficiency and comfort in running motion. Running strides with the prior art shoes usually consisted of landing on the heel portion of the shoe after a short period with no ground contact, then moving the body weight forward over the supporting foot, and then driving the rear portion of the foot upward so that the ball and toes support the body weight with the toes in a pronounced flexed position. And, finally, springing forward off the ball and toes to a similar sequence on the other foot. In the present invention the outer sole contour is such as to cause a preferred, more efficient, smoother sequence in the running stride.

A runner equipped with the footwear of the present invention lands upon a thickened portion of the sole forward of the ankle, rolls the ankle downward and rearward to eliminate shock, and then rolls forward with the mechanical assistance from the shoe configuration to the ball and toe supporting position with the forward portion of the sole structure supporting the toes in such a way that they are noticeably straighter. Finally, the runner springs forward with considerable force and efficiency because of the relatively straighter toe position. A similar sequence is repeated on the other foot.

One result of the stride sequence when using the shoe of the present invention is the sensation of being thrown forward immediately after landing again upon "toe-off." Another result is increased leg comfort and absence of muscle fatigue and joint pain after using footwear incorporating the principles of the present invention.

The present invention is adaptable for selective tailoring of the sole configuration to favor the speed aspect of running athletics such as in foot racing, which is the sensation of being thrown forward and having ideal toe-off position and thereby to gain markedly increased stride and running speed. On the other hand, a contour of sole structure may be selected to favor the comfort aspects of running athletics such as in long, slow, distance training, and blend the forward thrust features into a shape where smooth, less forceful takeoffs are encouraged and thereby to form the most relaxing and enjoyable footwear for slower speed running.

SUMMARY OF THE INVENTION AND OBJECTS

In summary the invention resides in a running shoe construction including a shoe upper for inclusion of the runner's foot, and having a sole structure configured to supply on the bottom surface a normal landing zone along the outside mid-foot area and a push-off zone in the forward inside region of the sole. The sole structure has a continuous bottom contour from heel to toe and is crowned in the mid-foot area in the landing zone. The sole bottom contour extends gradually upwardly from the landing zone to the heel region so that in the running stride on a level surface the heel region makes minimal, if any, contact with the ground surface. The sole bottom contour forwardly of the landing zone curves upwardly and the sole tapers in thickness to afford a pliable quality to the push-off zone of the sole, which induces a straighter toe position to yield a preferred push-off attitude. The contour between the landing zone and the push-off zone is such as to afford a rocker action to the foot during running.

The method of the present invention for making footwear concerns the steps of making a negative casting of one or, preferably, both of the runner's feet in a weight bearing condition and then forming a positive casting of the same. A pair of suspension members formed of a laminated or sponge thermoplastic material is made conformable to the bottoms of the positive casting and a reference surface is formed on the bottom of the suspension members. In another step, the outer shoe shell is formed with an inner reference surface matching that formed on the suspension member but with the shell formed without the outer sole. The suspension members are inserted into the outer shell and an outer sole is formed in the desired contour and adhered to the outer shoe shell to produce the footwear of the present invention.

One object of the invention, therefore, is to provide running shoes which will tend to smooth the blow or impact of the runner's normal running stride and eliminate a major portion of the waste up and down motion normally associated with the running stride.

Another object of the invention is to provide footwear for running formed such that the runner is subjected to forward force impulses for a portion of this running stride thus tending significantly to lengthen his normal stride.

Another object of the invention is to provide improved footwear for running to support the tarsus and to prevent the runner's arch from collapsing during the normal running stride.

Another object of the invention is to provide an improved method for manufacture of shoes for running which permits a ready correction of a runner's anatomical structural faults. Another object of the invention is to provide an improved method of manufacture of shoes which is adaptable for the many purposes for which athletic shoes are intended.

Further objects of the invention will become apparent from the following detailed description taken in association with the drawings.

DESCRIPTION OF THE PREFERRED EMBODIMENTS

Figure 1:
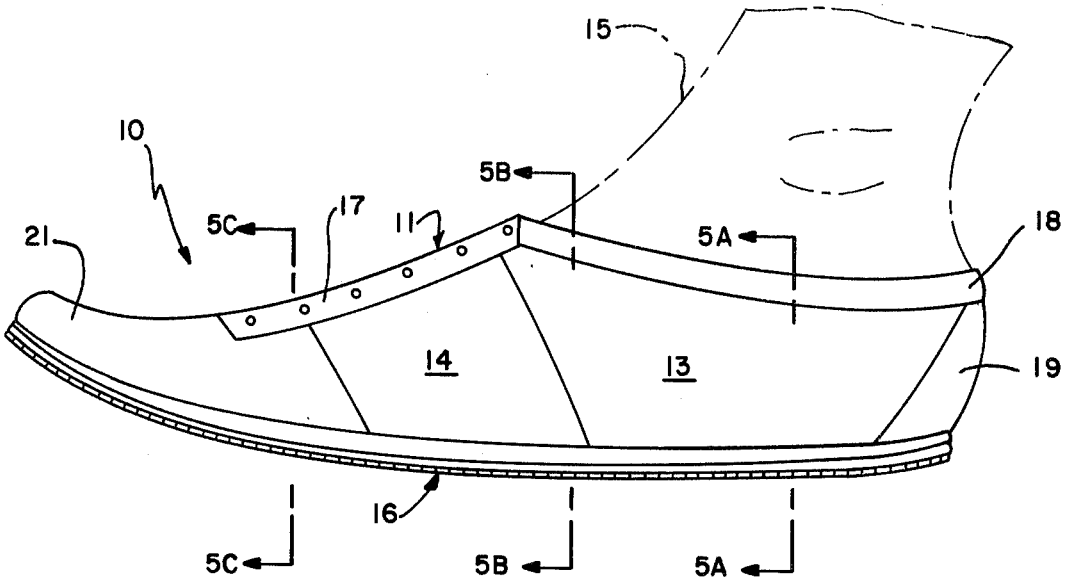
FIG. 1 is a general view of footwear for running constructed in accordance with the principles of the present invention showing in phantom lines a portion of the runner's foot. The unit is illustrated in a non-ground contacting or air borne position as during running.
Figure 3:
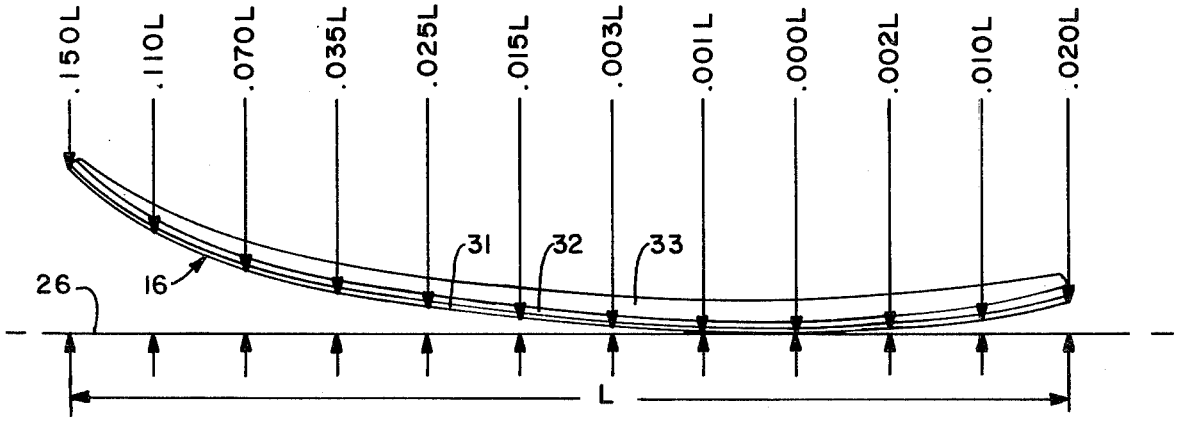
FIG. 3 illustrates tha sole contour of the footwear illustrated in FIG. 1 viewed in elevation.
Figure 6:
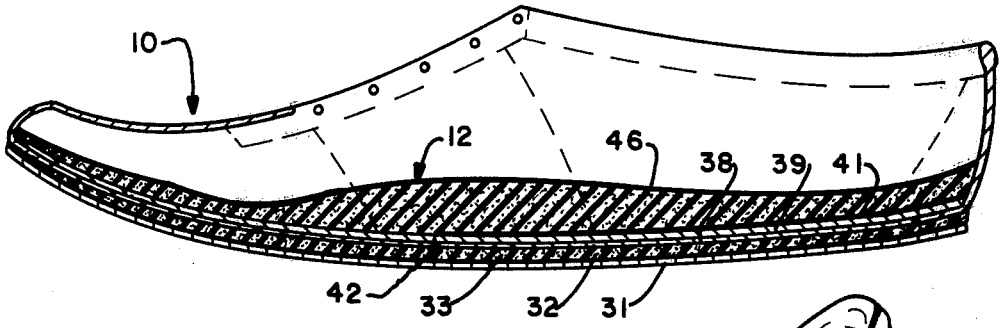
FIG. 6 is a longitudinally sectional view of the structure of FIG. 1.
Figure 7:
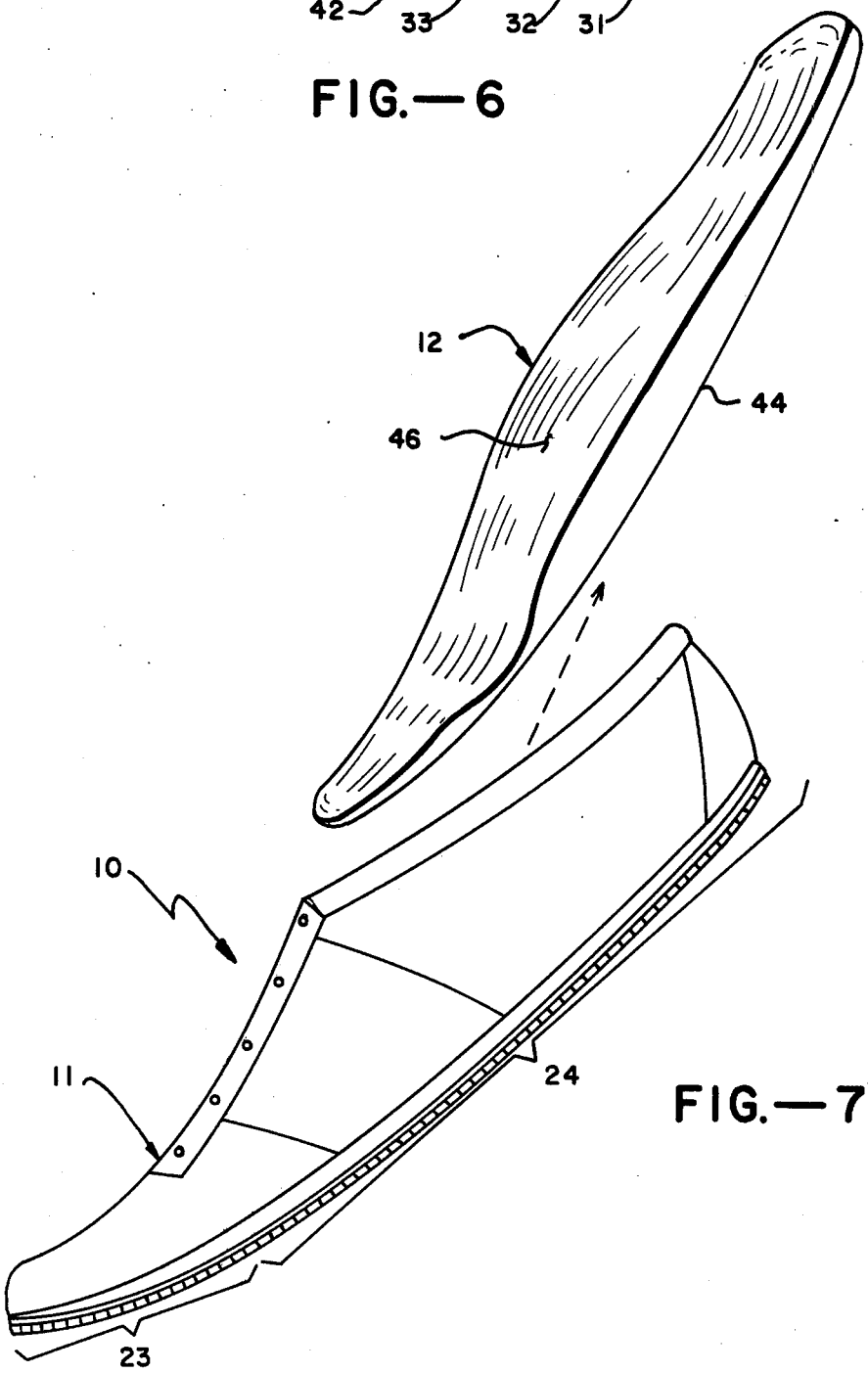
FIG. 7 is an exploded view showing the support structure of the present invention removed from the shoe shell.

One preferred embodiment 10 of improved footwear construction of the present invention is shown generally in FIGS. 1, 6 and 7 and comprises an outer shoe shell 11 and an internal foot support or suspension member 12 which may be incorporated either permanently or dismountably with respect to the outer shell 11. The footwear structure 10 is designed expressly for running as contrasted to walking and the contour of the sole in longitudinal section, FIG. 3, is illustrated herein for a running shoe for training. That is, running at a pace of between 6½ minutes to 8 minutes per mile. It shall be understood from FIG. 1 of the drawings, that the illustration there shows the shoe 10 mounted on the foot 15 of a runner with only the lower portion of the leg shown in phantom lines. The attutude of the foot 15 is shown at a point during the running stride where it is out of contact with the ground, i.e. airborne, and which is immediately prior to the ground engaging sequence illustrated in FIGS. 4A–4D.

In general the footwear construction 10 includes a shoe upper 13 which may be formed of pliable leather or fabric and which may include a saddle portion 14 and an eyelet strip 17. The upper 13 illustrated in the drawings is of the "low-shoe" style, and terminates just below the ankle of the runner in a padded rim portion 18 which serves to reduce abrasion against the foot. The upper 13 can include a reinforcing heel cap 19, extending from the rim 18 to the sole structure 16 and, at the opposite end, a toe-pocket 21. It will be recognized that the foregoing elements are bounded together forming a unitary shoe structure.

Figures 4A, 4B, 4C, 4D:
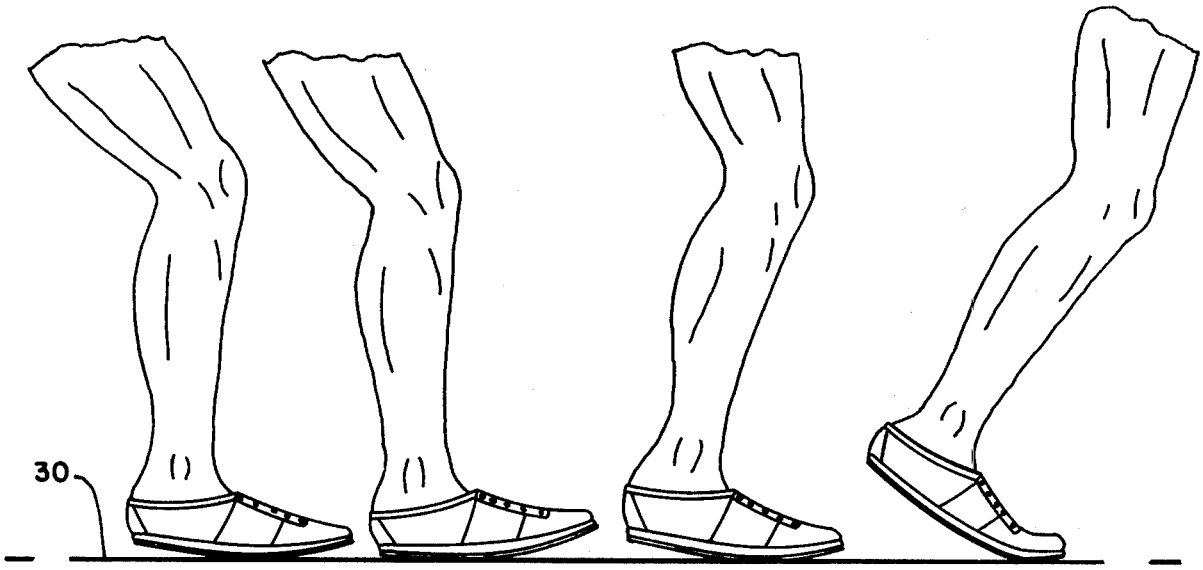
FIGS. 4A–D illustrate in sequence, the running stride enabled by the present invention and showing progressively the foot placement from landing through take-off, and corresponding to the letter sequence of FIG. 2.

The sole structure 16, by reason of its configuration, stiffness and pliability characteristics, forms a signifiicant portion of the present invention. More specifically, referring to FIG. 3, it will be seen that the sole structure 16 with respect to a datum plane 26 (which should not be confused with the running surface 30 represented in FIGS. 4A–4D), has a pronounced upward curvature in the forward portion so as to support the toes somewhat in an upward position for the push-off action of the foot which is illustrated in FIG. 4D. The rearward portion of the sole 16, as illustrated in FIG. 3, is also curved upwardly to a much lesser degree but so as to afford a space between the rear portion of the sole and a running surface 30. This shape functions to relieve the tendency of the runner to land on his heel (see FIG. 4A) thereby to avoid heel shock. As may be observed from FIG. 3, in elevation the contour of the sole 16 resembles somewhat the contour of the convex side of a banana in that each has a smooth and continuous contour from end to end. The numerical values in FIG. 3 indicate the distance of the sole from the datum 26 and are expressed in terms of relation to the length of sole "L". These are values for one preferred embodiment of the invention which has been reduced to practice and which provided successful results.

Figure 2:
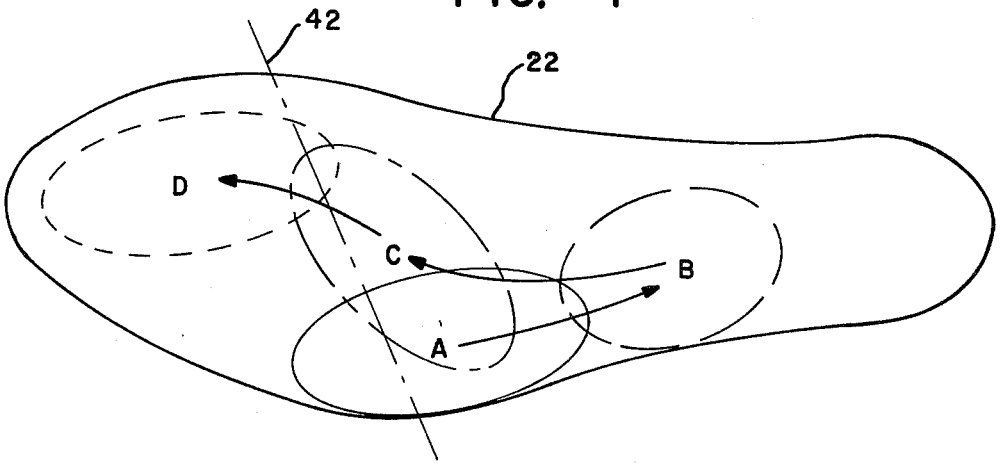
FIG. 2 is a plan view looking upwardly at the outer sole surface and illustrating in letter sequence the pressure zones from landing through toe-off.

By reason of the configuration of the outer sole structure 16, as well as the arrangement of other elements of the shoe 10 to be described below, the shoe 10 permits a smoother running action than was otherwise previously obtained. More specifically, referring to FIG. 2 it will be observed that a landing zone "A" is generally positioned on the sole outline 22, at an outer mid-sole location. The landing zone "A" generally indicates a center of foot pressure as respects the foot position indicated in FIG. 4A, which shows where the runner makes initial contact on the surface 30 in his running stride. Subsequently, the runner's foot weight may shift rearwardly a small distance as indicated by a transition zone "B" in FIG. 2, which corresponds to the foot position indicated in FIG. 4B. Nominal, if any, contact is made between the heel portion and the ground 30. With a forward rolling motion, the runner shifts ground contact of the sole from zone "B" to zone "C". See FIGS. 2 and 4C. This motion precedes the toe-off thrust and is accompanied by a shift of forces from the outer portion of the sole across the metatarsal area towards the knuckle of the large toe. In the toe-off, rearward thrust action of the sole is indicated by zone "D" in FIG. 2, also in FIG. 4D, wherein a tapered flexible forward portion 23 of the sole (see FIG. 7) undergoes flexure. This occurs immediately prior to the foot again becoming airborne, as represented in FIG. 1. It should be understood that the flexure of the sole portion 23 (as indicated in FIG. 4D) is by design relatively greater than the remainder of the sole 16 which is relatively stiff over the span 24 (see FIG. 7). This is in contrast to the prior art running shoe constructions which in general were flexible throughout the sole length.

To amplify the foregoing, the outer sole 16 is constructed from materials which serve to establish and maintain the desired contour of the sole. More specifically referring to FIGS. 5A–C, there is shown an outer tread layer 31 of the sole structure 16 which defines the wear layer of surface for engagement with the running surface 30. The material for layer 31 is selected for high abrasion resistance and preferably is formed from a high quality natural rubber having a durometer value of approximately 57. The thickness of layer 31 may be on the order of 0.10 inches. Bounded to layer 31 (as by vulcanization) is a relatively inextensible thermoplastic, fabric layer 32 which acts with the tread rubber layer 31 to eliminate substantially all stretch and scrubbing of the rubber layer 31 during running. This promotes long life for the outer tread material 31. A polyester fabric cloth has been used successfully for layer 32, for example as manufactured by the E. I. du Pont Company and sold under the registered trademark KEVLAR, as fabric style 328, 6.8 ounces per square yard, and with 17 threads per inch in each of two perpendicular directions. The Kevlar is impregnated with a suitable polyester resin to supply rigidity.

Bonded to the layer 32 is a body of relatively compressible open cell natural sponge rubber material 33. The cellular sponge material 33 may include in its physical characteristics a Young's modulus of about 80 psi. Another form of the material 33 can be synthetic sponge rubber having a durometer hardness on the C scale of between 40 and 50. In addition thereto the material 33 can be rubber lone, color blue, sheet size 10 mm×56 cm×77 cm, hardness 40°+50 type C measurement, which is a test of hardness known in the industry for cellular rubber material. Use of an open cell sponge material lends a spring rate which is substantially constant, independent of the applied compression rate. The material does not suffer from deformation or set upon continued high localized loading. The material should also be compounded to have surface tension characteristics which allow it to "shed" water and to have small pore sites so that it is homogeneous and does not wet. Another material which has been found suitable for the layer 33 is an ethylene vinyl acetate having a density on the order of 6 lbs. per cubic foot. The compression/deflection value of the material when impressed with a load on the order of about 15 psi is 10% to 40%. A compression/deflection value of 20% is the most suitable for the type of shoe construction disclosed herein. The layer 33 may have a basic thickness of 0.023L, where "L" represents the overall length of the sole (see FIG. 3). As observed from FIG. 6, the layer 33 is tapered in the forward portion 25 of the shoe so as to accentuate the forward flexibility in zone 23 for proper toe-off thrust for a training shoe (illustrated in FIG. 4D). The three layers of the outer sole 16 when united together can have the configuration illustrated in FIG. 3.

Figure 5A:
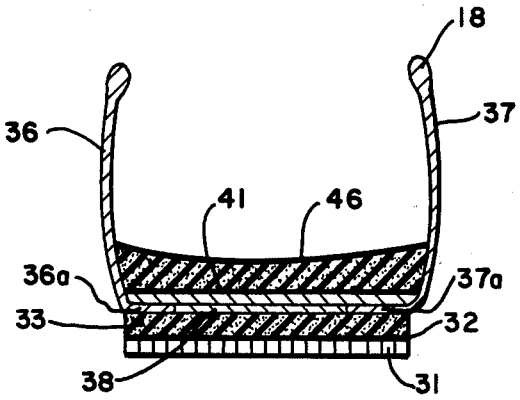
FIGS. 5A–C are transverse sectional views taken respectively in the direction of the arrows 5A–5C of FIG. 1.
Figure 5B:
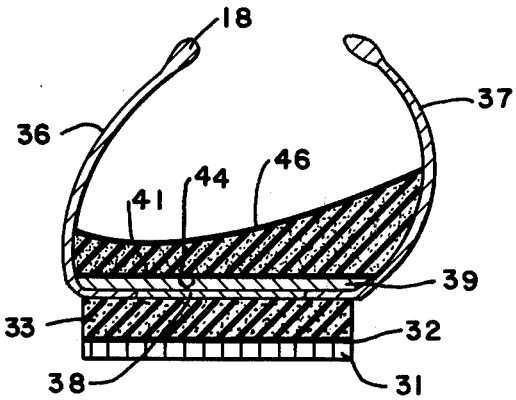
Figure 5C:
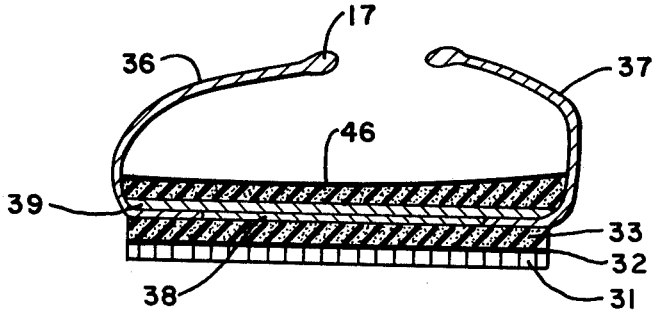

As mentioned above, the upper 13 may be formed of either a pliable leather or a fabric material. As shown in FIGS. 5A–5C, the unit 13 includes side walls 36, 37 which end in turned under portions 36*a*, 37*a*, respectively, between which there extends a filler material 38 of approximately the thickness of the walls 36, 37 so that the bottom of the upper 13 may be somewhat smooth for attachment to the outer sole 16. Within the upper 13 and attached to the turned over portions 36, 37 there is disposed a layer of paper 39, well known in the art, which extends the full length of the upper. Above the paper 39 there is arranged a layer 41 of thermoplastic material, such as the previously mentioned Kevlar impregnated with a polyester resin to supply rigidity. The layer 41 extends from the heel end of the shoe forwardly to terminate at a line 42 (FIGS. 2 and 6), located to follow a line through the principal knuckles from the great to the small toes (note absence in FIG. 5*c*). The thermoplastic layer 41 serves as the element which holds the contour of the upper 13 and provides in combination with layer 32, a relatively large degree of longitudinal stiffness along the span 24, FIG. 7. Thus, when the shell structure 11 is united to the sole 16, the unit will have the desired bottom contour as well as the desired stiffness along the span 24 and the desired flexibility along the span 23 by reason of arrangement of the elements discussed above. It should be understood that the inside surface of member 41 is formed parallel to the outside sole surface.

It is highly desirable in running that the foot be supported orthodically throughout the length by the shoe in the proper attitude for running including support for the toes in a somewhat upwardly inclined position so as to assist in the push-off. To this end a full length support or suspension member 12 is disposed within the outer shoe shell either permanently connected thereto or dismountably arranged as illustrated in FIG. 7. It is highly desirable that the suspension member 12 conform as nearly as possible to a weight bearing contour of the foot, and so that the foot can fill the void between the support member and the inner surface of the upper 41. An open cell sponge rubber material including in its mechanical characteristics a Young's modulus of about 50 psi has been found very advantageous. A compression/deflection value of about 25% when impressed with a load of about 15 psi was found very effective. The upper surface of the suspension system 12 is covered with an anti-abrasion cloth material 46 so that the shoes may be worn without socks.

METHOD OF MANUFACTURE

The method of fabricating footwear of the present invention embraces two related systems. The first is a system wherein the shoes are made specifically for the individual's feet and provisions are made to account for his peculiar foot shape, running style and anatomical problem. The second system permits forming the footwear of the present invention in standard sizes which may satisfactorily fit the majority of runners but still permits a measure of customizing to accommodate individual variations in anatomical structure. The flow sheet of FIG. 8 of the drawings depicts in simplified form a sequence of steps for forming a pair of shoes adapted specifically to an individual runner and his peculiar problem. The procedure is flexible to accommodate a wide number of anatomical differences and problems in runners such as Morton's toe, a displacement of the metatarsal or undue length of the second toe, shortness of one leg, foot pronation, and the like.

A first step 51 in custom forming a pair of running shoes to the runner is to make a casting of one or, preferably, both of the runner's feet while the feet are fully loaded with the body weight. One preferred technique for casting the feet in this condition is to arrange a casting platform comprising at least two superimposed pieces of polyurethane foam having a density of about 5 lbs./cu.ft. with the upper layer about 1 inch thick and the lower layer on the order of about 3 inches thick. Both layers could have dimensions of about 18 inches on the side. This material was selected so as to approximate hydrostatic pressure reacting against the runner's weight as it is placed upon this casting platform. A sheet of flexible plastic film material of about 0.001 inch thickness may be stretched over the top surface of the platform to prevent adhesion of the pool of plaster of paris casting material which is positioned in the center portion of the platform. The pool of casting material should be of a quantity sufficient to enclose both feet together. The individual's feet may be protected from sticking to the plaster of paris by the use of thin rubber socks or another layer of the plastic film material stretched over the plaster of paris. The individual then steps into the pool of plaster of paris, placing his weight evenly on both feet with the legs moderately flexed so that the load is spread uniformly under each foot. The near hydrostatic pressure of the polyurethane foam seems to cause the foot to assume its "neutral" load geometry. The individual runner holds his position until the plaster of paris "freezes" to cause the plaster of paris to retain the female (negative) molding shape of the feet and capturing such details as neutral geometry and pronation. At this point, the individual runner carefully removes his weight from the casting platform and simultaneously "wiggles" his feet from the plaster of paris so as not to disturb the casting form. The thinner layer of polyurethane material at the top of the casting platform has insufficient strength to crack the negative mold when weight is removed by the individual.

Figure 8:
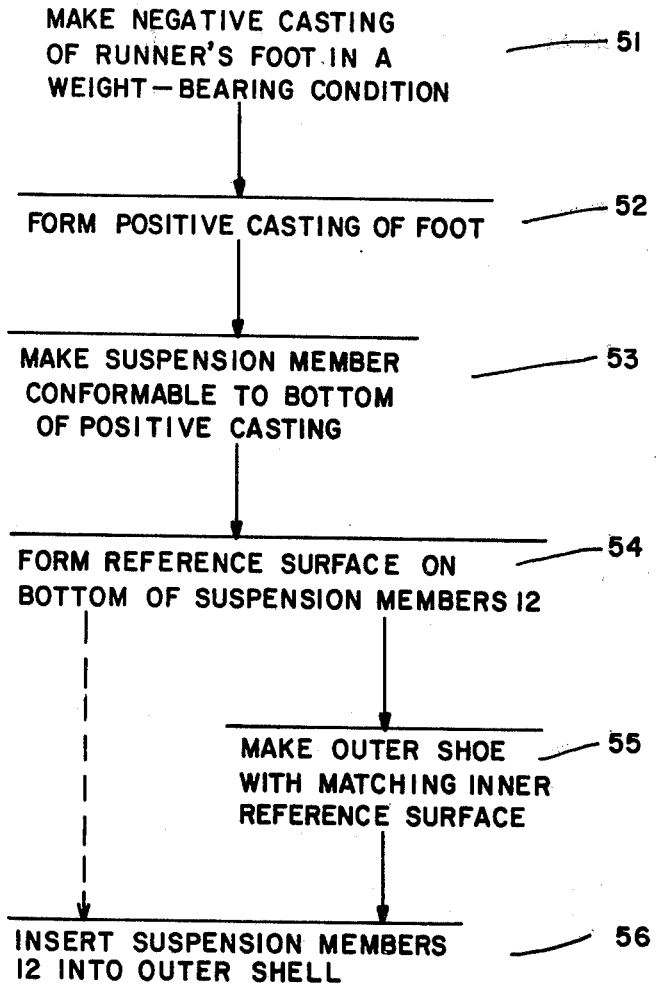
FIG. 8 is a flow sheet indicating the steps in the process of the present invention for making footwear.
Figure 9:
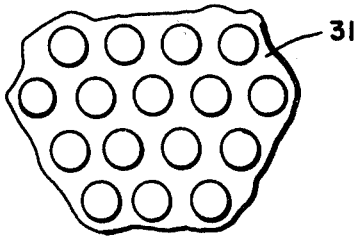
FIG. 9 is a view of a tread pattern on the sole structure of the present invention.

Step 52, FIG. 8, of the sequence concerns making a male or positive casting from the female mold formed in step 51. The male casting includes a bridge between the two feet portions so that the degree of pronation can be observed and measured for use in later forming the support member 12. Individual differences between the left and right foot may be observed when the positive casting includes both feet bridged together. Plaster of paris is a suitable material with which to make the positive or male casting of the feet and other materials are well known in the field.

Step 53 in the flow sheet, FIG. 8, concerns making the suspension member 12 conformable to the positive casting made in step 52. As example of a satisfactory technique for carrying out this step is first to heat a layer of about ½ inch thick of open cell sponge rubber containing a high thermoplastic content to a temperature range where the material is heat-softened. When in this state, the sponge rubber material 46 is applied to each foot portion of the positive, plaster of paris cast. The heated sponge material 46 is held in contact with the positive mold until cooling or "freezing" has occurred. In this step, an exact negative of the foot, from heel to toe, is formed on one surface of the sponge material. Another technique is to use multiple, thin layers laminated to a stratified contour without heating the material.

Step 54 in the flow sheet concerns establishing a reference surface 44 on the opposite side of the suspension member 12. This may be done as by grinding or the like, to provide a base surface which is substantially perpendicular to the erect body position of the runner. Further, this reference surface will match the contour of the inside reference surface of the outer shoe shell 11 defined by the layers 39 and 41. The reference surface formed opposite the foot engaging surface of the support member 12 permits variations in anatomy to be accommodated within the subject method of forming footwear. Such conditions as pronation, shortness of one leg, and the like as well as a support for a "Morton's toe" condition in either foot may be accommodated.

Step 55 in the flow sheet concerns making the outer shoe shell 11. A suitable procedure for carrying out step 55 is to form the shoe upper 13 on a thin layer base as defined by the layers 38, 39 and 41 in FIGS. 5*a*, 5*b*. The layer 41 is of relatively stiff plastic material which assists in holding the shape of the upper 13, and provides a reference surface complementary to that of the members 12. It extends from the heel to about reference line 42, FIG. 2, which is just beneath the ball of the foot. Also included is the operation of forming the outer sole structure, layers 31–33, in a curved configuration, like that of FIG. 3, and thereafter adhering the outer shoe structure to the outer shell 11. The bottom tread surface 31 may be vulcanized to the thermoplastic layer of Kevlar 32, which in turn may be bonded to the layer 33 of open cell sponge rubber containing a high plastic content. The upper may be formed otherwise in a conventional manner but the inside volume is controlled so that the upper will accept the suspension system 12 in the intended manner. Step 56 of the flow sheet concerns insertion of the suspension system 12 into the outer shoe shell 11—as indicated in FIG. 7. At this point it will be recognized that the suspension system 12 may be either removably disposed with respect to shoe shell 11 or may be securely bonded in place. However, if the suspension member 12 is dismountable from the shell 11, a number of different shoe configurations may each receive the same support member 12 giving great versatility to the present design.

From the above it will be observed that there has been disclosed an improved form of footwear for runners which permits a smooth running style and which affords great comfort to the runner serving to minimize injuries to the feet and legs. The disclosed process for manufacturing footwear permits control of the shape of the footwear so that a pair of shoes may be made to accommodate all of the idiosyncrasies of the particular runner. Additionally, the sequence of steps in the manufacture operation is such that a standardized outer shoe shell 11 is formed to accommodate a standardized size suspension member 12 wherein the individual suspension members could be modified later to fit the runner's foot more precisely. The invention as disclosed above shall be limited only as expressed in the following claims.

I claim:

1. In shoe construction for running athletics including a shoe upper for inclusion of the runner's foot, the improvement comprising, a sole structure configurated to supply on the bottom surface a normal landing zone along the outside mid-foot area and a push-off zone in the forward inside region of the sole, the sole structure having a continuous bottom contour from heel to toe, the sole bottom contour extending gradually upwardly from the landing zone to the heel region so that in the running stride, on a level surface the heel region makes minimal, if any, contact with the ground surface, the sole bottom contour forwardly of said landing zone curving upwardly and the sole tapering in thickness to afford a pliable quality to said push-off zone of the sole, the contour between the landing zone and the push-off being such as to afford a rocker action to the foot during running.

2. The improvement of claim 1 wherein said sole structure consists of an outer sole tread material and an inner sole suspension member, said inner sole suspension member being formed of a compressible shape-retaining material having a compression/deflection value of about 25% when impressed with a load of about 15 psi.

3. A shoe construction for running athletics comprising a shoe upper having an enclosed volume greater than that required to enclose the runner's foot and an inside reference surface extending from heel to toe which throughout its length is generally flat in lateral section and curved in longitudinal section from heel to toe and including a suspension member dismountably arranged within such shoe upper to occupy the volume between the underside of the runner's foot and the shoe insole and extending the full length of such shoe upper, said suspension member having an upper surface conforming generally to the contour on the underside of the runner's foot when in a body-weight bearing condition, the runner's body being erect and generally perpendicular to a horizontal running surface, the bottom surface of said suspension member having a contour which is generally flat in lateral section and conforming and complimentary to said inside reference surface from heel to toe position, said suspension member being formed of a resilient cellular material having a Young's modulous of about 50 psi and a compression/deflection value of about 25% when impressed with a load of about 15 psi.

4. The shoe construction of claim 3 wherein a substantial portion of said reference surface is defined by a relatively inextensible thermoplastic material.

5. In shoe construction for running athletics including a shoe upper for inclusion of the runner's foot the improvement comprising, a sole structure configurated to supply on the bottom surface a normal landing zone along the outside mid-foot area and a push-off zone in the forward inside region of the sole, the sole structure having a continuous bottom contour from heel to toe, the sole bottom contour extending gradually upwardly from the landing zone to the heel region so that in the running stride on a level surface the heel region makes minimal, if any, contact with the ground surface, the sole bottom contour forwardly of said landing zone curving upwardly and the sole tapering in thickness to afford a pliable quality to said push-off zone of the sole, the contour between the landing zone and the push-off zone being such as to afford a rocker action to the foot during running, said sole structure being formed from at least three layers of material and including a bottom tread surface layer formed from a rubber material with a high abrasion resistance having a durometer value of about 57, said bottom layer being bonded onto a second layer of relatively inextensible, thermoplastic material serving to attenuate stretch and scrubbing of said bottom layer, and a third layer of relatively compressible, cellular material.

6. The improvement of claim 5 wherein said bottom tread layer includes a tread pattern of a plurality of spaced apart buttons on the outer surface of the sole structure.

7. The shoe construction of claim 5 wherein said shoe upper includes along the bottom portion thereof a longitudinally extending layer of relatively inextensible, thermoplastic material coacting with the layer of thermoplastic material in the sole structure for maintaining longitudinal stiffness from the heel of the shoe forwardly to at least the knuckle supporting portion of the shoe.

* * * * *